US011654439B2

(12) United States Patent
Prihoda

(10) Patent No.: US 11,654,439 B2
(45) Date of Patent: May 23, 2023

(54) METHOD FOR IMPROVING THE PRODUCTIVITY OF GRINDING PLANTS

(71) Applicant: Helmut Prihoda, Waldshut (DE)

(72) Inventor: Helmut Prihoda, Waldshut (DE)

( * ) Notice: Subject to any disclaimer, the term of this patent is extended or adjusted under 35 U.S.C. 154(b) by 243 days.

(21) Appl. No.: 17/055,254

(22) PCT Filed: May 7, 2019

(86) PCT No.: PCT/DE2019/100414
§ 371 (c)(1),
(2) Date: Nov. 13, 2020

(87) PCT Pub. No.: WO2019/219124
PCT Pub. Date: Nov. 21, 2019

(65) Prior Publication Data

US 2021/0268511 A1 Sep. 2, 2021

(30) Foreign Application Priority Data

May 15, 2018 (DE) ..... 10 2018 111 621..7

(51) Int. Cl.
*B02C 15/00* (2006.01)
*B02C 4/30* (2006.01)
*B02C 25/00* (2006.01)

(52) U.S. Cl.
CPC ..... *B02C 15/005* (2013.01); *B02C 4/305* (2013.01); *B02C 15/003* (2013.01); *B02C 25/00* (2013.01); *B02C 2210/02* (2013.01)

(58) Field of Classification Search
CPC ... B02C 15/005; B02C 15/305; B02C 15/003; B02C 25/00; B02C 2210/02
See application file for complete search history.

(56) References Cited

U.S. PATENT DOCUMENTS 4,389,767 A * 6/1983 Burbach ..... B22D 19/16 29/527.3
4,848,683 A * 7/1989 Kawatsu ..... B02C 2/005 241/300
5,050,810 A * 9/1991 Parham ..... B22D 19/10 241/293
2008/0191074 A1* 8/2008 Hagedorn ..... B02C 4/305 148/540

(Continued)

FOREIGN PATENT DOCUMENTS

CN 203944423 11/2014
CN 204034783 12/2014

(Continued)

OTHER PUBLICATIONS

Chinese office action dated Jul. 20, 2021 for Chinese patent application No. 2019800317192, with English translation.

(Continued)

*Primary Examiner* — Faye Francis

(74) *Attorney, Agent, or Firm* — McDonnell Boehnen Hulbert & Berghoff LLP

(57) ABSTRACT

The present invention relates to a method for improving the productivity of grinding plants, wherein, after the optimum wear geometry of the grinding units has been reached by conventional operation of the grinding plant, the optimum wear geometry is preserved by applying a thin wear protection layer to the surface of the grinding units.

12 Claims, 2 Drawing Sheets

(56) References Cited

U.S. PATENT DOCUMENTS

| | | | | |
|---|---|---|---|---|
| 2011/0259983 | A1* | 10/2011 | Botto | B21K 25/00 241/191 |
| 2014/0291428 | A1* | 10/2014 | Sharman | B02C 15/005 241/278.1 |
| 2017/0348694 | A1 | 12/2017 | Olsson | |
| 2019/0119802 | A1* | 4/2019 | Suidzu | C23C 4/10 |

FOREIGN PATENT DOCUMENTS

| | | | | | |
|---|---|---|---|---|---|
| CN | 105149049 | | | 12/2015 | |
| CN | 105536957 | | | 5/2016 | |
| CN | 113457793 | B | * | 5/2022 | |
| DE | 4235297 | A1 | * | 4/1994 | B02C 4/305 |
| DE | 4235298 | A1 | * | 4/1994 | B02C 4/305 |
| DE | 4235499 | A1 | * | 4/1994 | B02C 4/305 |
| DE | 10137131 | A1 | | 3/2003 | |
| DE | 102005028568 | A1 | | 1/2007 | |
| JP | 5810143 | | | 1/1983 | |
| JP | 7275728 | | | 10/1995 | |
| JP | 11309596 | | | 11/1999 | |
| JP | 2000354778 | | | 12/2000 | |
| KR | 102152721 | B1 | * | 1/2020 | B02C 15/007 |
| SB | 2559422 | | | 8/2018 | |
| WO | WO-2015188828 | A1 | * | 12/2015 | B02C 4/305 |
| WO | 2016101952 | A1 | | 6/2016 | |

OTHER PUBLICATIONS

Japanese office action (notice of reasons for refusal) dated Jun. 29, 2022 for Japanese patent application No. 2020-564475, with English translation.
English translation of German office action dated Jan. 3, 2019.
International Search Report for WO 2019219124.

* cited by examiner

METHOD FOR IMPROVING THE PRODUCTIVITY OF GRINDING PLANTS

CROSS REFERENCE TO RELATED APPLICATION

This application is a U.S. national phase of International Application No. PCT/DE2019/100414, filed May 7, 2019, which claims priority to German Patent Application No. 102018111621.7, filed May 15, 2018, both of which are incorporated by reference herein in their entirety.

The present invention relates to a method for improving the productivity of grinding plants, wherein the optimal wear geometry of grinding plants is preserved by applying a protective layer, thereby reducing the susceptibility of the plants to failure and improving their productivity.

BACKGROUND OF THE INVENTION

The crushing effect of grinding tools is particularly influenced by the development of wear. The harder the particles being ground are, the greater the material loss or wear on the grinding tool—which in turn influences the throughput and product quality of the grinding plant. The specific energy requirement during the grinding process changes as a function of wear. The energy requirement follows a so-called "bathtub curve," where the energy requirement initially decreases, then enters a constant phase, and finally increases steeply as the grinding units wear down.

PRIOR ART

Various techniques are currently utilized to reduce the costs of grinding processes and to stabilize product quality and mill throughput. For example, worn grinding units or grinding elements are exchanged or repaired by welding. In both cases, the original geometry of the grinding units is restored.

An improvement in wear protection and minimization of wear in grinding plants leads to an increase in the availability of the plant, a reduction in downtimes, and an extension of maintenance intervals. In particular, three different groups of materials are used today to protect the grinding units from wear.

Grinding parts made of chrome cast iron have become standard materials in daily use. These materials have very good resistance to abrasion, such that, with a consistent hardness of 630 to 800 HV20, uniform, predictable wear is achieved and the repair intervals can be planned accordingly. The service life of these materials can also be increased by buildup welding.

In general, grinding tools made of cast steel can be made more wear-resistant by build-up welding. In build-up welding, a high-alloy material is applied as surface protection to high-load components. The welding materials contain chromium and carbon; according to the desired wear resistance, other carbide-forming substances such as niobium, vanadium or others can be used.

The third group of materials includes grinding parts made from composite castings. In this case, two or more materials are constructively combined to form a composite material. The grinding tools are preferably made of a metal matrix composite material, with ceramic fittings being embedded in a ductile cast iron. In this way, particularly hard and wear-resistant grinding tools are obtained.

For example, DE 39 21 419 A1 describes a roller mill in which the grinding surfaces of the grinding rollers and grinding track are protected by integrated ceramic segments. The grinding elements are armored by applying the segments made of a much more wear-resistant material, which increases the service life of the grinding elements.

DE 203 21 584 U1 describes a roller mill which has a grinding chamber with a rotating grinding track and grinding rollers which roll along it. In order to ensure an extremely high level of operational reliability, six grinding rollers are arranged in a 3×2 roller mill. In accordance with the modular system, there is thus the possibility for the roller mill to be briefly halted and for a pair of rollers to be pivoted out in the event of malfunctions or damage to the wear parts of the rollers. The roller mill can then continue to operate with four grinding rollers while the removed grinding rollers are repaired. In this way, a production halt can be avoided.

The measures described above to increase the wear resistance of grinding units and/or to secure reliable production are used successfully today. Nevertheless, even today, the wear of the grinding elements during the grinding processes is still a quality- and cost-determining factor, such that there continues to be a need to find options and methods to reduce the wear on grinding units and/or grinding elements.

OBJECTIVE AND DESCRIPTION OF THE INVENTION

The object of the present invention is to offer a method which makes it possible to increase the service life of grinding units and/or grinding elements beyond the degree known in the prior art.

The object is achieved by a method for improving the productivity of grinding plants, which first includes the step of reaching the optimal wear geometry of the grinding units by operating the grinding plant conventionally. The optimum wear geometry is found when the specific energy requirement of the grinding plant reaches a minimum for a prespecified throughput. The energy requirement is continuously measured and recorded to verify and determine when the optimal wear geometry is reached. The optimum wear geometry is then preserved by applying a thin wear protection layer to the surface of the grinding units or grinding elements—in particular, the grinding rollers and grinding plates.

All known methods can be used for applying the wear protection layer. The thin wear protection layer is preferably applied by build-up welding or laser cladding.

Hard metals or carbide hard materials, such as WC, CrC, TiC, VC, TaC and NbC, by way of example, can be used as the material for the wear protection layer, wherein in a preferred embodiment of the present invention, hard metals are applied which are doped with appropriate carbide-forming substances according to the desired wear resistance.

The method according to the invention is particularly suitable for vertical roller grinding plants, wherein the grinding units or grinding elements to be coated are grinding rollers and grinding plates.

The layer thickness of the applied wear protection layer is preferably 1 to 5 mm.

The invention also relates to grinding elements which have grinding surfaces coated on the surface with a thin wear protection layer. According to the invention, the grinding elements have an optimal wear geometry which is determined by continuous measurement and recording of the energy requirement during the grinding process, and which is defined as the geometry for which a minimum of the energy requirement is reached at a prespecified throughput.

In an advantageous embodiment, the wear protection layer is a buildup-welded layer.

In a further advantageous embodiment of the present invention, the grinding elements are parts of a vertical roller grinding plant, and the coated surfaces are the grinding surfaces of grinding rollers and grinding plates. The layer thickness of the thin wear protection layer is advantageously 1 to 5 mm.

The present invention is based on the knowledge and the idea that the grinding elements or grinding units in most known grinding processes eventually develop an optimal wear geometry, which is only made possible by the wear of the grinding elements and which automatically arises after a certain operating time of the grinding plant. The energy requirement follows a so-called "bathtub curve," where the energy requirement initially decreases, then enters a constant phase, and finally rises steeply as the grinding units wear down. The energy consumption can therefore be used to determine when the optimal wear geometry has been achieved. The optimum wear geometry is achieved when the energy consumption is at a minimum for a constant throughput. This state, in which the product quality also remains at a constant level, corresponds to the optimum for the grinding method.

Over a longer period of operation, the geometry of the grinding elements changes due to progressive wear, and the energy requirement increases while productivity decreases. Beyond a certain wear geometry, the wear of the grinding elements increases so rapidly that the grinding elements must be repaired or replaced if a qualitatively and quantitatively compensated grinding operation is to be ensured. At this stage, the grinding plant is particularly susceptible to production interruptions, since vibration peaks occur when the grinding process is unsteady—which makes it necessary to interrupt continuous production in order to prevent a total failure of the plant. The result is that the availability of the plant decreases, product quality decreases, and product yield drops drastically. In all current grinding techniques, this state is reached after a certain period of operation, and must be remedied by repairing or replacing the grinding elements, since further operation of the plant at this point no longer makes economic sense.

The present invention is based on the idea of preserving the ideal state in which the grinding elements have their optimal wear geometry, and thus improving the productivity (yield, costs and quality) of the product which is ground. Since this state is reflected in a minimum of the energy requirement being reached, the optimal point in time for preservation of the corresponding geometry can be determined in a simple manner by continuous measurement and recording of the energy requirement. According to the invention, a thin wear protection layer is applied to the wear-prone part of the surface of the grinding units or grinding elements at this point in time, such that the geometry of the grinding elements is not changed, while the wear resistance of the surface is increased and the geometry is thereby preserved. If the plant continues to be operated, the geometry will change less quickly compared to an unpreserved geometry, such that the ideal state is maintained for longer and the grinding plant can be operated for a longer period of time without additional downtime.

By repeatedly using this method, the plant can be operated continuously over a long period of time in the optimal geometry range. In particular, the operation can also be monitored by regular wear measurements and, depending on the state of wear of the grinding elements, the necessary regeneration or preservation measures can be undertaken in order to obtain the optimum wear geometry and to enable continuous operation.

The invention will be explained in more detail below using a numerical example for a grinding plant for cement. According to conservative estimates, the measures described above should improve the availability of the grinding plant by more than 5%, which corresponds to an increase in productivity of 5%. For a production of 200 t/h, this corresponds to an additional production of 86,400 t/a—which, at a realistic profit of €12/t—would correspond to additional earnings of €1,036,800. At the same time, for a typical energy requirement of 28 kWh/t, continuous operation with optimal wear geometry would save an estimated minimum of 3% in energy costs—which, at energy costs of approx. €0.15/kWh for an annual production of 1.5 million tons (90% utilization was calculated), would correspond to €189,000.

BRIEF DESCRIPTION OF THE DRAWINGS

Preferred embodiments of the invention are described below with reference to drawings, these being intended only as an explanation and not to be interpreted as restrictive. In the drawings.

DESCRIPTION OF PREFERRED EMBODIMENTS

The invention is explained in detail below with reference to the drawings listed above.

Figure 1:
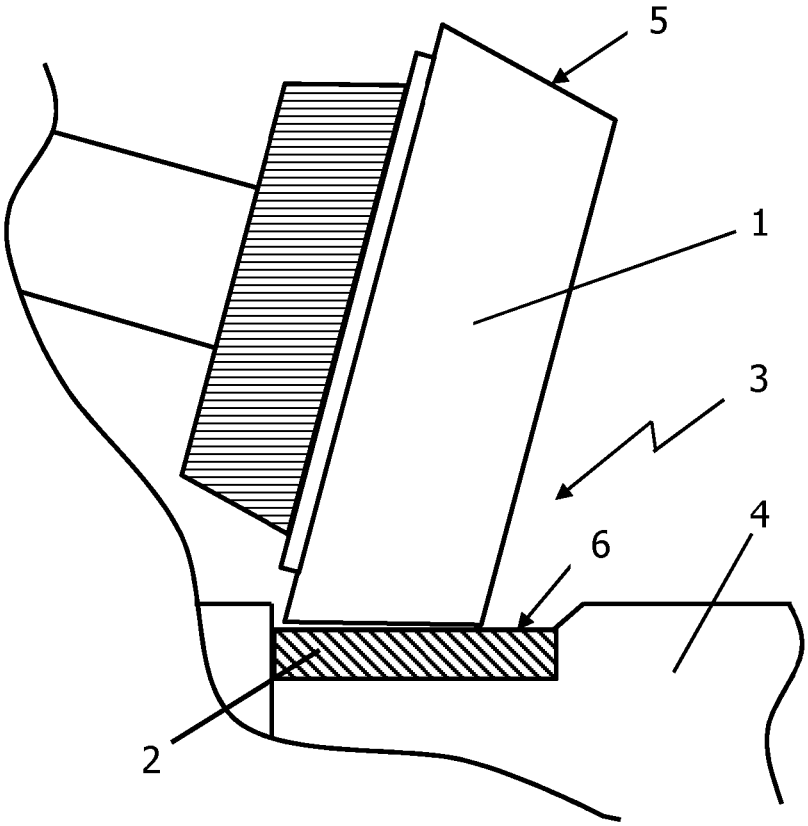
FIG. 1 is a sectional view of a detail of a vertical roller grinding plant.

FIG. 1 is a sectional illustration of a detail of a vertical roller grinding plant, as is used, for example, in the cement industry. A stationary, rotatable cylindrical grinding roller 1 is resiliently pressed against a rotatingly driven grinding table or grinding track 4, the grinding track 4 being reinforced with grinding plates 2 in the area against which the grinding rollers 1 are pressed. The grinding units or grinding elements (grinding rollers 1 and grinding plates 2) are in their original state and have a smooth, undamaged profile 5, 6.

Figure 2:
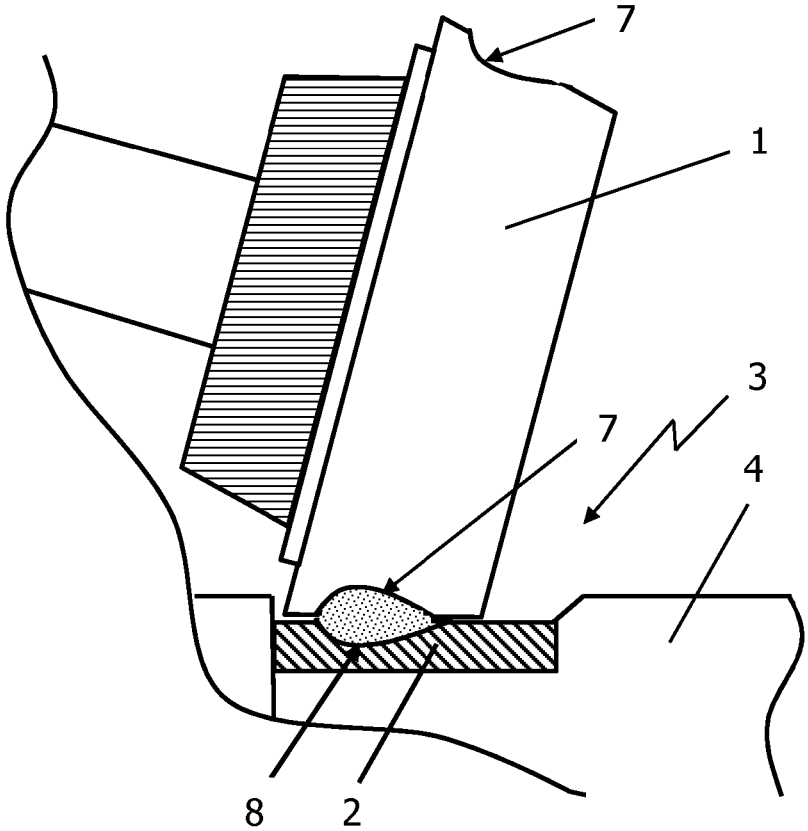
FIG. 2 is a sectional view of a detail of a vertical roller grinding plant.

FIG. 2 shows the same arrangement as FIG. 1 after longer grinding operation; the grinding rollers 1 and also the grinding plates 2 now have their typical wear profiles 7, 8.

Figure 3:
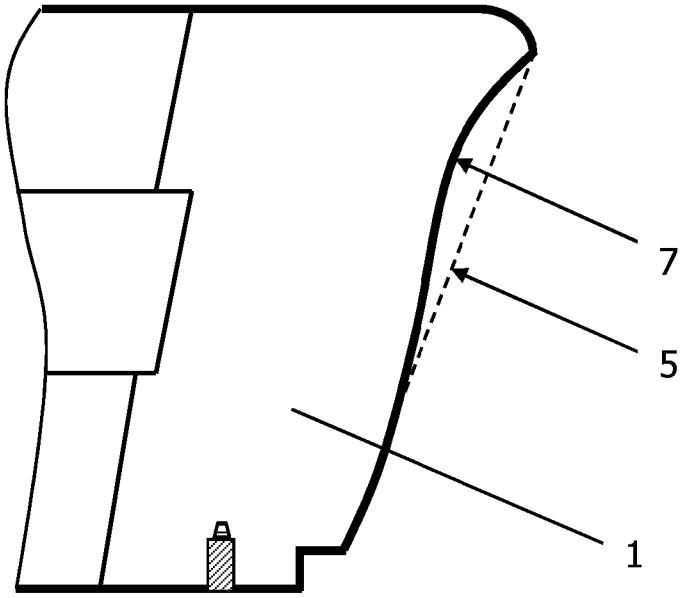
FIG. 3 is a sectional view of a detail of a roller of a vertical roller grinding plant.

In FIG. 3, a detail of a grinding roller 1 can be seen in a sectional view; the grinding roller 1 has reached its optimum wear profile 7. The original profile 5 is shown in dashed lines in this illustration.

Figure 4:
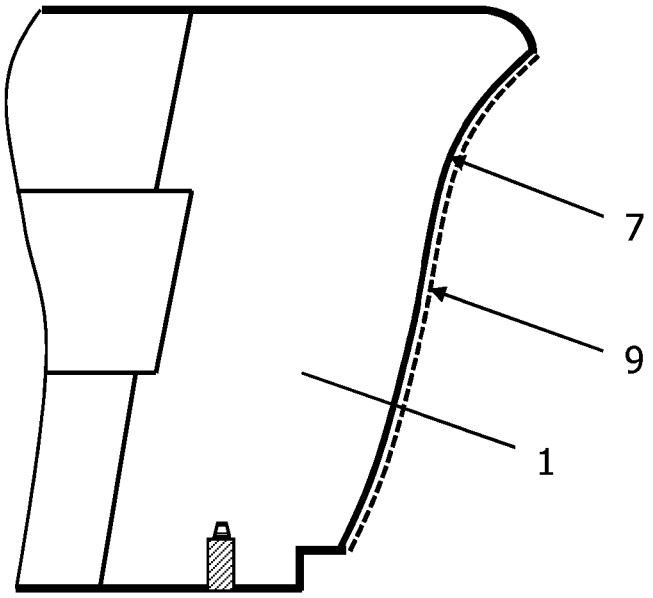
FIG. 4 is a further sectional view of a detail of a roller of a vertical roller grinding plant.

Finally, FIG. 4 shows the grinding roller 1 in the same manner of representation as FIG. 3, wherein the optimal wear profile 7 thereof is now preserved with a thin wear protection layer 9, which in the present case is shown by dashed lines.

The grinding plates 2 have also reached an optimal wear profile, which is preserved in the same way with a thin wear protection layer. An additional graphic representation of the grinding plates 2, which have a comparable optimal wear profile as the grinding rollers 1, has been omitted at this point.

As already mentioned at the outset, the drawings described above are intended only as an explanation and are not to be seen as a restriction. Thus, the principle of the inventive idea can be applied to any other grinding plant in which an optimal wear geometry is also established on its wear parts during operation. The formation of the wear protection layer is also not limited to buildup welding; rather, it can be implemented using any other known technique. It is only necessary to ensure that the right time is selected for the preservation of the optimal wear geometry in order to fully exploit the advantages of the present invention.

As such, the present invention can advantageously also be combined with other known methods for increasing the wear resistance of grinding units and/or for securing reliable production. If, for example, as described in DE 203 21 584 U1, grinding rollers can be pivoted out while the system is in operation, virtually without stopping production, the optimal wear profiles can be preserved on the surfaces of the grinding rollers without causing a loss of production—and the repair interval for the system will be extended at the same time.

LIST OF REFERENCE SYMBOLS

1 Grinding roller
2 Grinding plate
3 Grinding chamber
4 Grinding track
5 Original profile (grinding roller)
6 Original profile (grinding plate)
7 Wear profile (grinding roller)
8 Wear profile (grinding plate)
9 Wear protection layer

The invention claimed is:

1. A method for improving the productivity of vertical roller grinding plants having grinding rollers and grinding plates as grinding units, the method comprising the steps of:

operating a vertical roller grinding plant until an optimum wear geometry of grinding units of the vertical roller grinding plant is present, wherein the presence of the optimum wear geometry is determined by measuring that specific energy required to operate the grinding plant reaches a minimum for a constant throughput, wherein the presence of the optimum wear geometry is monitored by continuously measuring and recording an energy demand during grinding operation, and preserving the optimum wear geometry by applying a thin wear protection layer to a surface of the grinding units.

2. The method according to claim 1, wherein the thin wear protection layer is applied by means of buildup welding.

3. The method according to claim 2, wherein a material for the wear protection layer is hard metal.

4. The method according to claim 2, wherein the thin wear protection layer is a hard metal layer.

5. The method according to claim 2, wherein a layer thickness of the thin wear protection layer is 1 to 5 mm.

6. The method according to claim 1, wherein a material for the wear protection layer is hard metal.

7. The method according to claim 6, wherein the thin wear protection layer is a hard metal layer.

8. The method according to claim 6, wherein a layer thickness of the thin wear protection layer is 1 to 5 mm.

9. The method according to claim 1, wherein the thin wear protection layer is a hard metal layer.

10. The method according to claim 1, wherein a layer thickness of the thin wear protection layer is 1 to 5 mm.

11. The method according to claim 1, wherein a material for the wear protection layer is selected from the group comprising WC, CrC, TiC, VC, TaC and NbC.

12. The method according to claim 2, wherein a material for the wear protection layer is selected from the group comprising WC, CrC, TiC, VC, TaC and NbC.

* * * * *